US005904055A

United States Patent [19]

Slais

[11] Patent Number: 5,904,055

[45] **Date of Patent: *May 18, 1999**

[54] ACCUMULATOR DEFLECTOR HAVING A PLASTIC BUSHING

[75] Inventor: Robert J. Slais, West Bloomfield, Mich.

[73] Assignee: Automotive Fluid Systems, Inc., Troy, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/707,781

[22] Filed: Sep. 16, 1996

Related U.S. Application Data

[60] Provisional application No. 60/003,981, Sep. 19, 1995.

[51] Int. Cl.[6] ..... F25B 43/00

[52] U.S. Cl. ..... 62/503; 248/56

[58] Field of Search ..... 62/503; 248/56, 248/51

[56] References Cited

U.S. PATENT DOCUMENTS

| | | | |
|---|---|---|---|
| 3,768,115 | 10/1973 | Hoffman et al. | 248/56 |
| 4,033,535 | 7/1977 | Moran | 248/56 |
| 4,111,005 | 9/1978 | Livesay . | |
| 4,270,934 | 6/1981 | Widdowson et al. . | |
| 4,299,363 | 11/1981 | Datschefski | 248/56 |
| 4,474,035 | 10/1984 | Amin et al. . | |
| 4,496,378 | 1/1985 | Kish . | |
| 4,550,451 | 11/1985 | Hubbard | 248/56 |
| 4,768,355 | 9/1988 | Breuhan et al. . | |
| 4,901,395 | 2/1990 | Semrau | 248/56 |
| 4,905,940 | 3/1990 | Luka | 248/56 |
| 5,184,479 | 2/1993 | Koberstein et al. . | |
| 5,245,842 | 9/1993 | Searfoss et al. . | |
| 5,557,078 | 9/1996 | Holwerda | 248/56 |

*Primary Examiner*—William E. Tapolcai
*Attorney, Agent, or Firm*—Vanophem Meehan & Vanophem, P.C.

[57] ABSTRACT

An accumulator dehydrator, for use in an automotive air-conditioning system, includes an inlet, an outlet tube located below the inlet, a deflector for preventing liquid refrigerant fluid from entering an inlet end of the outlet tube located just below the deflector and a deflector assembly for connecting the deflector to the outlet tube of the accumulator. The assembly includes a thermoplastic bushing connected to a passage in the deflector and having the outlet tube received therein, the bushing creating a sufficient interference fit between the deflector and the outlet tube to prevent the deflector from moving during operation. In an alternate embodiment, the bushing includes an extended skirt having a diameter coinciding with an inner diameter of the deflector, the extended skirt preventing liquid refrigerant fluid from wrapping around the lip of the deflector and entering the inlet end of the outlet tube.

9 Claims, 4 Drawing Sheets

ACCUMULATOR DEFLECTOR HAVING A PLASTIC BUSHING

This application cross references and claims priority to application Ser. No. 60/003,981 filed Sep. 19, 1995. This application also relates to copending application Ser. No. 08/701,174 Aug. 21, 1996 assigned to the common assignee hereof.

BACKGROUND OF THE INVENTION

1. Field of the Invention

The present invention relates generally to accumulator devices for air-conditioning systems. More particularly the present invention relates to an accumulator dehydrator for use in an automobile's air-conditioning system and the attachment of a deflector, or baffle, within the accumulator housing, to an outlet tube.

2. Description of the Prior Art

One type of vehicle air-conditioning system includes a compressor, a condenser, an evaporator and an accumulator dehydrator. Accumulator dehydrators (or accumulators) for vehicle air conditioning systems function to allow liquid refrigerant to change to a gaseous refrigerant fluid or vapor prior to being sent to the compressor. The accumulator receives liquid and gaseous refrigerant fluid from the evaporator through an inlet tube and ensures only gaseous or vaporous refrigerant fluid is sent to the compressor by means of an outlet tube.

Most accumulator assemblies incorporate a baffle plate or deflector situated within the accumulator can, near the top of the accumulator, to prevent the liquid refrigerant entering the accumulator from entering the exit tube. The liquid refrigerant fluid flows onto the deflector and is dispersed down the sides of the accumulator housing. An outlet tube, or "J" tube, passes through the deflector and through the top of the accumulator to return the gaseous refrigerant fluid to the compressor.

One example of the prior art type deflector is U.S. Pat. No. 4,474,035, awarded to Arnin et al., the specification of which is incorporated herein by reference. Prior art accumulator deflectors are generally assembled to the inside of the accumulator housing by means of a press or interference fit. The deflector usually has protrusions equally spaced apart from each other and contacting the inside diameter of the accumulator can resulting in an interference fit which is intended to hold the deflector in place. However, these types of deflectors are difficult to assemble and are not compatible with all types of material, in particular, aluminum.

U.S. Pat. No. 4,768,355, awarded to Bretban et al., discloses a cartridge positioned within the accumulator can for processing the flow of refrigerant fluid. The cartridge casing embodies retention and locating structures extending from the casing. The outlet tube is connected to the cartridge by the combination of a coupling tube and an O-ring seal. The combination coupling tube and O-ring seal comprise a port for sealingly receiving the outlet tube and means for connecting the refrigerant processing cartridge with the outlet tube. The cartridge itself is retained within the accumulator housing by means of retention and locating tabs which contact embossments on the inner surface of the accumulator housing.

U.S. Pat. No. 5,184,479, awarded to Koberstein et al., discloses an accumulator with an outlet tube within the housing which exits at the bottom of the housing, and an outlet tube shield, or deflector, mounted at the top of the housing to temporarily impede the flow of refrigerant passing between the inlet tube and the outlet tube. The outlet tube shield is welded or brazed to the inlet tube between the housing and the free end of die outlet tube.

These known accumulator assemblies are usually made of metal, such as steel. When applying the interference fit design of prior art deflectors to an accumulator made of aluminum, difficulties result from tolerance stack-up, hardness, and coefficients of friction. Because aluminum has a lower elasticity than steel, it is not possible to apply the press fit design for a steel accumulator deflector directly to an aluminum application. In addition, aluminum to aluminum contact tends to gall and fuse together when an interference fit is attempted.

A solution may lie in tack welding each of the protrusions on the accumulator deflector to the inside of the accumulator housing. Bead locking or other mechanical operations may be used as potential solutions as well. However, these additional assembly and process steps add unnecessary complexity and cost to the accumulator. The mechanical operations also introduce the potential for failure.

U.S. Pat. No. 4,111,005, awarded to Livesay, discloses a press-on baffle that is made entirely of plastic. The baffle is secured by three, spaced apart upwardly tapered webs each of which supports a vertically extending arcuate rib portion providing a press fit with the standpipe or outlet tube.

The problem with this approach is the inflexibility in the design of the plastic baffle. The baffle must be designed around a specific standpipe diameter to successfully retain the standpipe. The costs associated with a large die for intricate plastic molding are very high. In addition, the plastic baffle surface is not as durable as aluminum or steel in an area which must withstand refrigerant fluid pulsing in from the compressor at relatively high pressures and cycle rates.

Based upon the above, it should be appreciated that there is still a need to provide an accumulator having a deflector which is inexpensive, easy to manufacture and install, and will withstand the relatively harsh environment inside an accumulator dehydrator.

It is an object of the present invention to improve the design of an accumulator deflector assembly and eliminate problems associated with using aluminum such as blowby of refrigerant fluid past an all-aluminum deflector without adding unnecessary cost or processing steps to the accumulator and its assembly process.

SUMMARY OF THE INVENTION

An accumulator for use in a vehicle air-conditioning system includes a housing, an inlet tube, an outlet tube, a deflector, and a bushing for connecting the deflector to the outlet tube. The inlet tube connects to the accumulator housing for introducing fluid refrigerant into the accumulator. The accumulator housing also has an outlet opening through which the outlet tube extends. A deflector, or baffle, made preferably of metal and in particular aluminum, is located below the inlet opening and deflects incoming refrigerant fluid to the sides of the accumulator housing. The deflector prevents liquid refrigerant fluid from being sent to the compressor of the air-conditioning system by means of the outlet tube. The outlet tube passes through a hole in the deflector and extends outside the accumulator housing.

A bushing, made of thermoplastic, such as nylon, is placed within the accumulator deflector at the point through which the outlet tube passes through the deflector in order to create an interference fit between the accumulator deflector and the outlet tube within the accumulator housing to prevent refrigerant fluid from blowing by the deflector.

Where prior art devices rely on a tack weld to hold the deflector in place within the accumulator housing, the present invention holds the outlet tube in place by means of the nylon bushing to provide a complete seal around the outlet tube. If the tack weld between the outlet tube and the accumulator housing breaks loose, the deflector will not move, as the nylon bushing will remain in place holding the deflector on the outlet tube. If the outlet tube slips within the accumulator housing, the deflector is not affected and remains firmly attached to the outlet tube.

The bushing is designed to create a seal between the accumulator deflector and the outlet tube eliminating the need for additional brazing or welding of the outlet tube to the accumulator deflector thereby simplifying processing of the accumulator as well as improving the overall performance of the accumulator by preventing blowby of refrigerant fluid.

The present invention, in an alternative embodiment, contemplates an extended skirt integral with the nylon bushing to aid in preventing liquid refrigerant fluid from reaching the inlet end of the outlet tube.

It is an object of the present invention to provide design flexibility which allows each subcomponent of the assembly to be changed without necessarily affecting the design of other components. This results in continuous improvement of tie accumulator system.

It is a further object of the present invention to provide a seal between the deflector and the outlet tube thereby simplifying processing of the accumulator and improving its performance.

It is yet a further object of the present invention to improve the overall performance of an accumulator.

DETAILED DESCRIPTION OF THE PREFERRED EMBODIMENT

Figure 1:
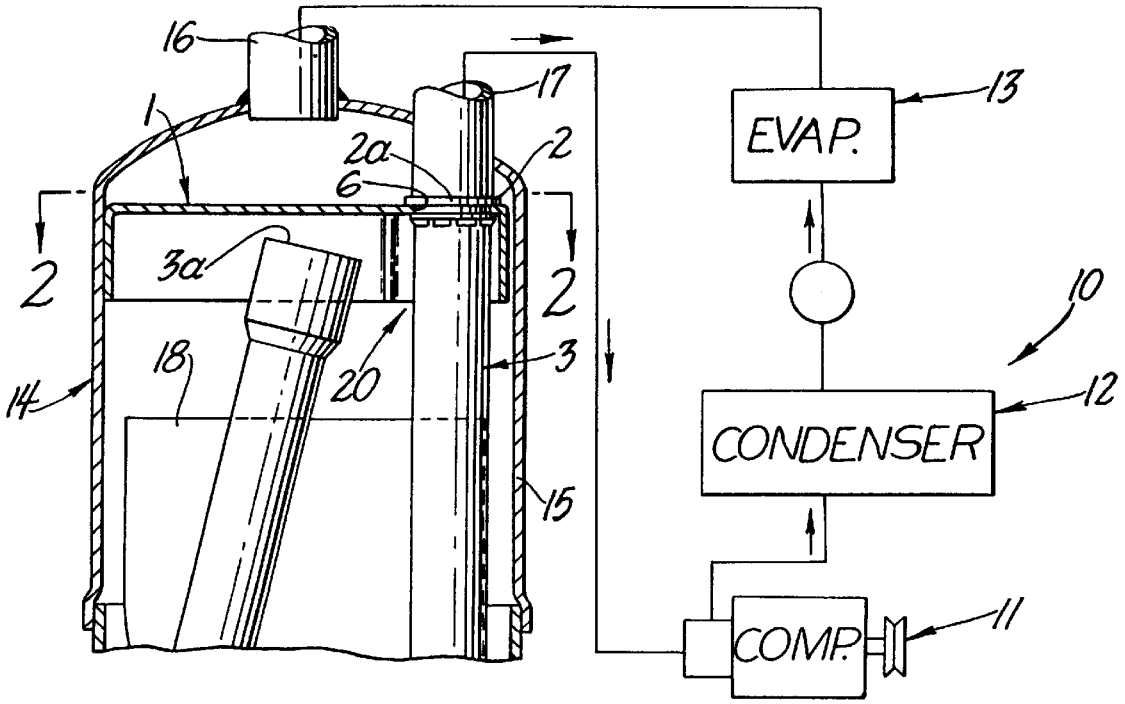
FIG. 1 shows the accumulator deflector assembly of the present invention as part of an overall air-conditioning system.
Figure 2:
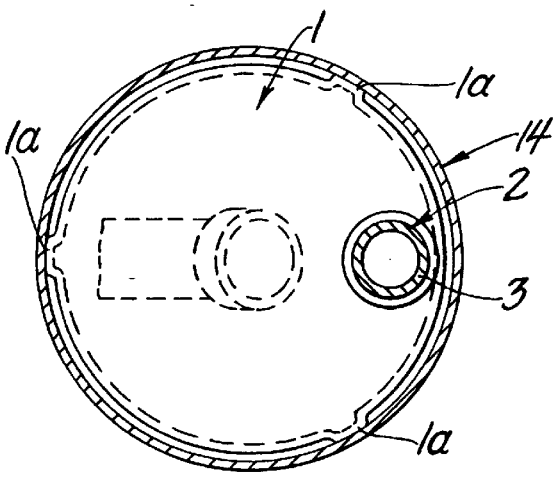
FIG. 2 shows a top view, along line 2—2 in FIG. 1, of the accumulator deflector assembly within an accumulator housing.
Figure 3:
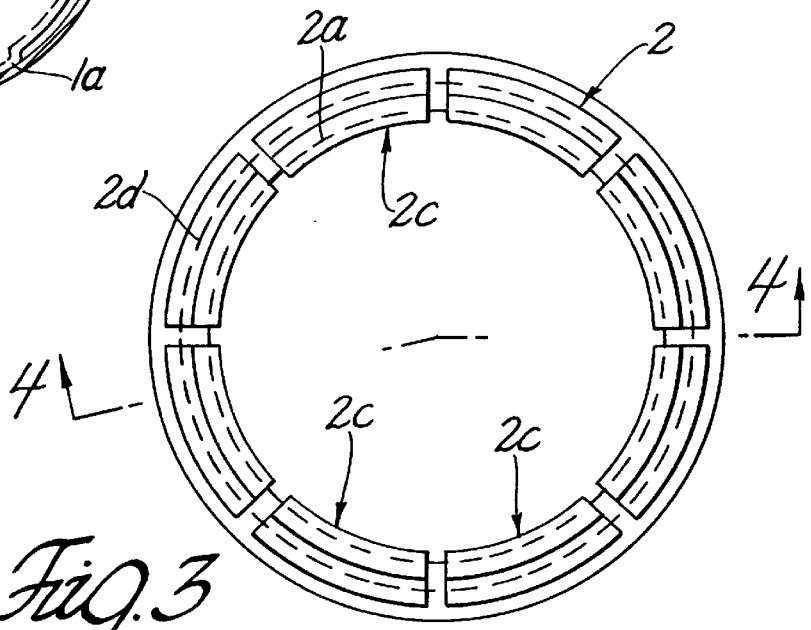
FIG. 3 is a view of the bushing of the first embodiment of the present invention which shows the bushing having an angled diameter with vertical grooves to allow for expansion of the bushing diameter when a conduit passes through the bushing.

Referring generally to FIGS. 1 through 16, and currently in particular to FIGS. 1 through 4, a generally conventional vehicular air-conditioning system 10 is shown. This system includes a compressor 11, a condenser 12, an evaporator 13 and an accumulator 14. The accumulator 14 primarily consists of an accumulator housing 15, which may be of any type of design, an inlet 16 located at the top of the housing 15, an outlet 17, a desiccant 18, and an accumulator deflector assembly generally referenced as 20. The accumulator deflector assembly 20 of the present invention preferably includes a deflector 1, a bushing 2, and an outlet or "J" tube 3.

The deflector 1, preferably made from aluminum, is secured in place within the accumulator housing 15 by means of the bushing 2, preferably made of nylon, and is designed to create a sufficient interference fit between the deflector 1 and the outlet tube 3 passing through a hole or passage 6 in the deflector 1 to secure the deflector 1 in place during operation along with the use of tabs 1*a* positioned about The circumference of the deflector 1. In one embodiment, the bushing 2 is located between the deflector 1 and the outside diameter of the outlet tube 3. The deflector 1 is at least partially held in place within the accumulator housing 15 through the support of the bushing 2 on the outlet tube 3. The bushing 2 is preferably made of a one piece construction, to simplify assembly and improve reliability of the accumulator as well as help eliminate the effects of vibration on the deflector.

In a first embodiment of the present invention, shown in FIGS. 1 through 4, the deflector 1 has the hole 6 for receiving the bushing 2. The outlet tube 3 is inserted through the bushing 2 and held in place by means of an interference fit which allows for assembly but which prevents slippage while in service. The deflector 1 connected to the outlet tube 3 will withstand the force of the refrigerant fluid as it is pumped into the accumulator due to the interference fit.

Figure 4:
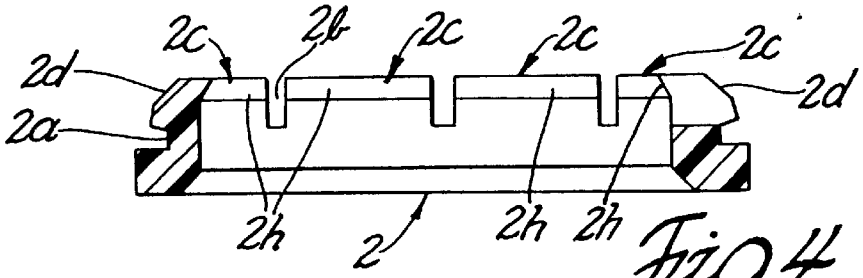
FIG. 4 shows a cross section of the bushing of the first embodiment of the present invention taken along line 4—4 in FIG. 3.
Figure 5:
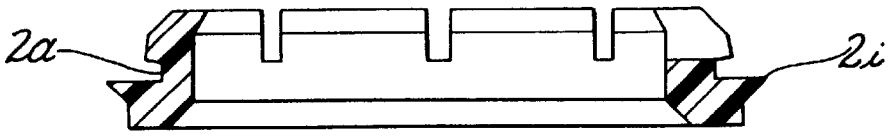
FIG. 5 shows a cross section of a variation of the bushing in the first embodiment of the present invention.

The bushing 2 has a circumferential groove 2*a* having a height only slightly larger or even with the thickness of the accumulator deflector 1. In addition to the circumferential groove 2*a*, the bushing 2 has vertical grooves 2*b* preferably equally spaced circumferentially about the diameter of the bushing 2 which define a plurality of tabs 2*c* each having a chamfered edge 2*d*, as best shown in FIG. 4. The vertical grooves 2*b* provide a flexibility in the bushing 2 allowing the diameter to contract when the bushing is inserted into the hole 6 in the deflector 1. After insertion of the bushing 2 in the deflector 1, the "J" tube 3 is inserted within the bushing 2. The bushing 2 preferably further includes art extended inner edge 2*h* for sealing with the "J" tube which prevents blowby of refrigerant fluid past the deflector 1. Thus, the deflector 1 is connected to the outlet tube 3 and is held in place within the accumulator housing 15 by the bushing 2 and the tabs 1*a* of the deflector 1.

FIG, 5 shows a bushing 2 similar to that shown in FIG. 4 but further including an outer annular extension 2*i* in the form of a chamfer located proximate the circumferential groove 2*a*. The annular extension 2*i* helps to secure the bushing 2 to the deflector 1 and further helps to seal the bushing 2 with the deflector 1 which helps to prevent refrigerant fluid from blowing past the connection between the deflector 1 and the outlet tube 3.

Figure 6:
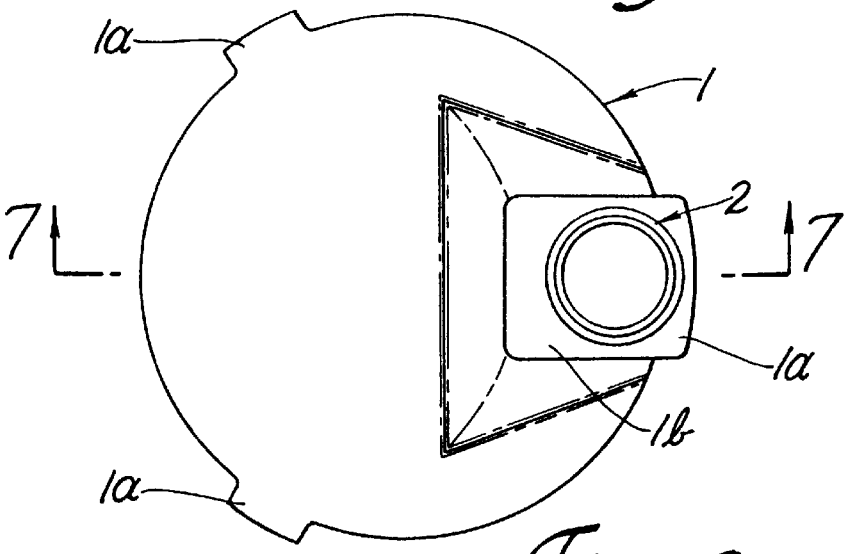
FIG. 6 shows a top view of the accumulator deflector of the present invention.
Figure 7:
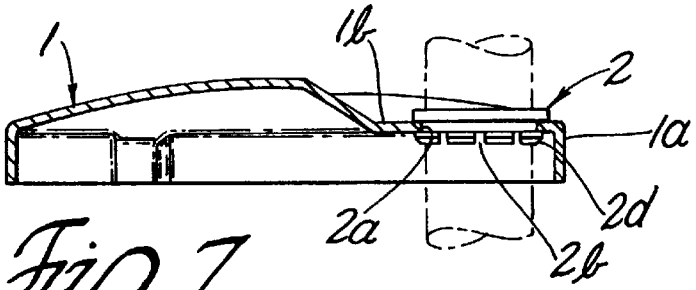
FIG. 7 shows a section, taken along line 7—7 of FIG. 6, of the accumulator deflector of the present invention with a portion of the "J" tube shown passing through the bushing.
Figure 8:
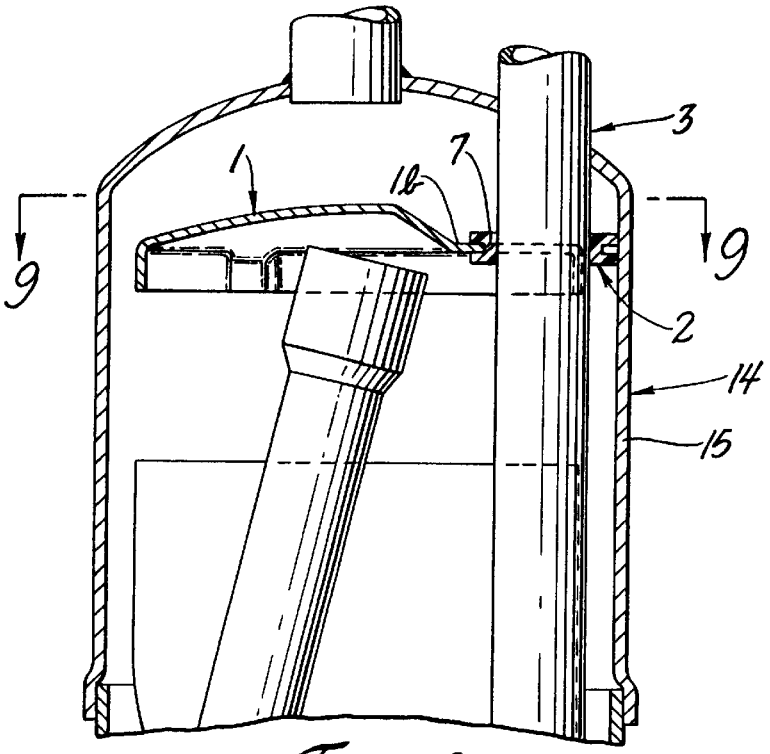
FIG. 8 shows an accumulator assembly of a second embodiment of the present invention in which the bushing creates an interference fit between the accumulator deflector and the accumulator housing.

It is also possible to use the bushing 2 with a domed deflector 1 having a depressed or flattered portion or flat 1*b* as shown in FIG. 6 and FIG. 7. The flattened portion or flat 1*b* allows the bushing 2 to be used with the domed deflector 1 and avoid problems with leakage or blowby and offset angles due to the curvature of the domed deflector 1.

Figure 9:
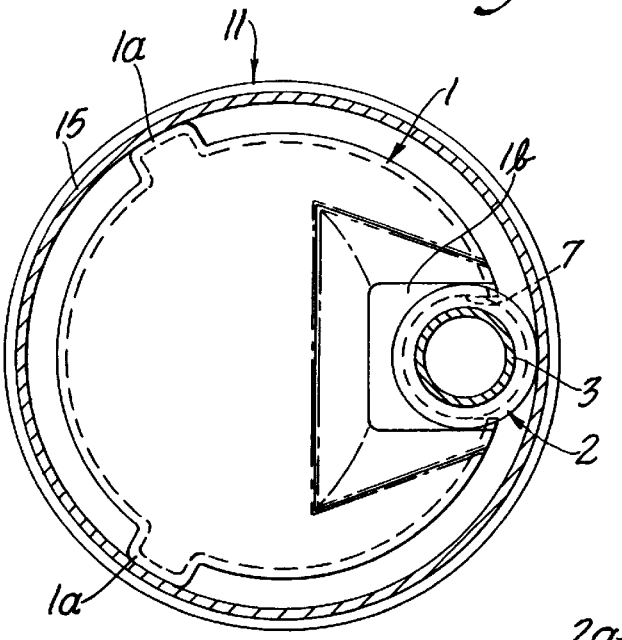
FIG. 9 is a section taken along line 9—9 of FIG. 8 showing the top view of the accumulator deflector with a slot for receiving the bushing according to the present invention.
Figure 10:
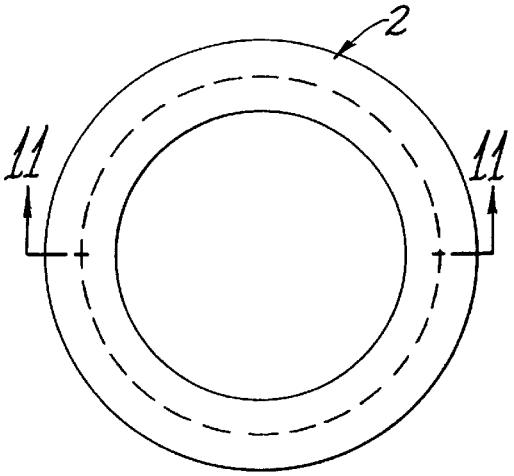
FIG. 10 is a detail of the bushing for the second embodiment of the present invention shown in FIG. 8.
Figure 11:
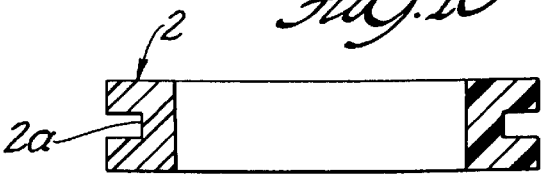
FIG. 11 is a cross-sectional view taken along line 11—11 FIG. 10
Figure 12:
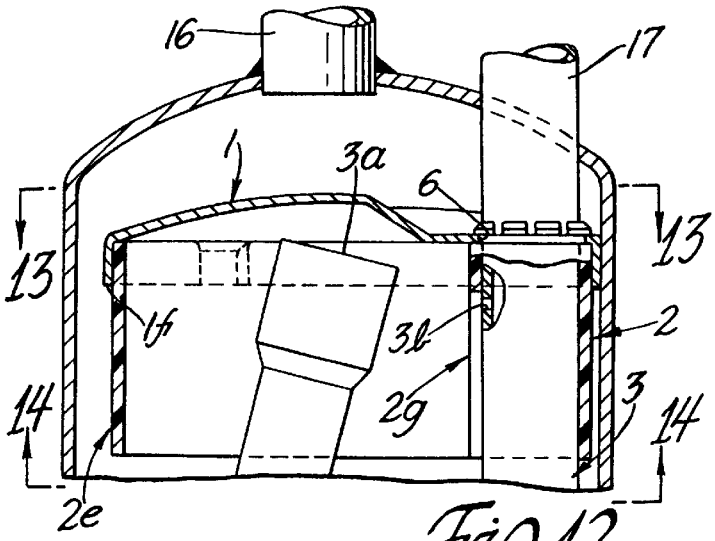
FIG. 12 is a third embodiment of the present invention in which the nylon bushing includes an extended skirt.
Figure 15:
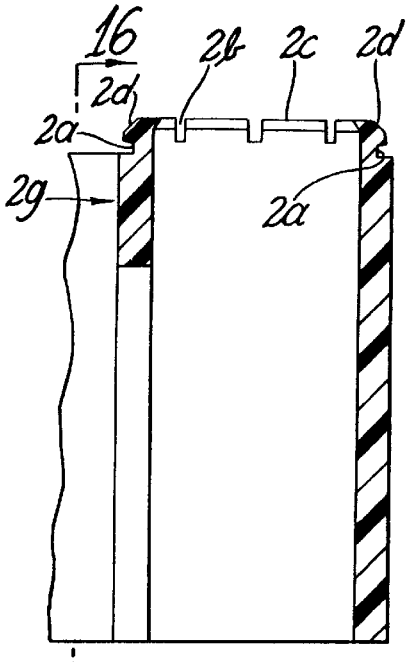
FIG. 15 is partial, cross-sectional view of the bushing of the third embodiment of the present invention as shown in FIG. 12.
Figure 13:
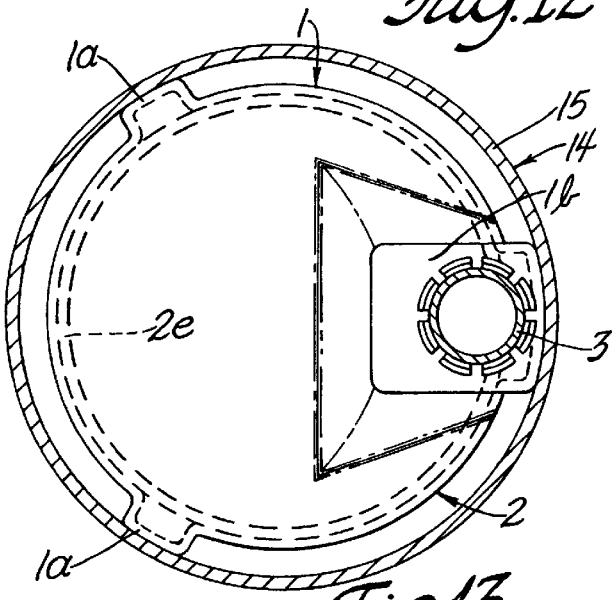
FIG. 13 is a top view of the accumulator deflector assembly as assembled within the accumulator housing taken along line 13—13 of FIG. 12.
Figure 16:
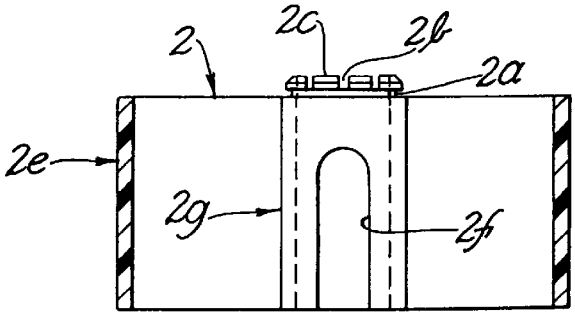
FIG. 16 is a cross-sectional view taken along line 16—16 of FIG. 15 further detailing the bushing of the third embodiment of the present invention.
Figure 14:
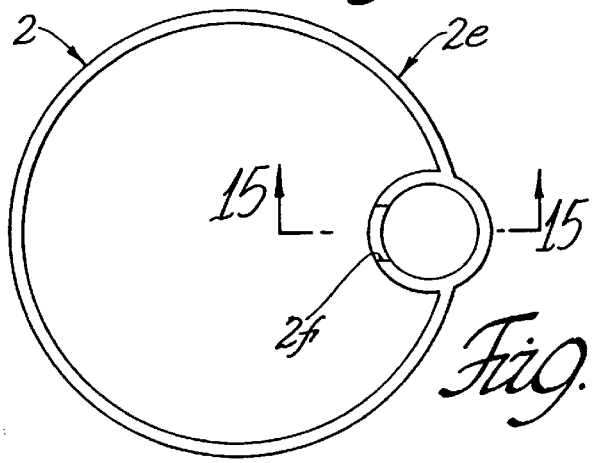
FIG. 14 is a bottom view of the accumulator deflector assembly, without the "J" tube, taken along line 14—14 of FIG. 12.

In a second embodiment of the present invention the deflector 1 has a slot 7, as opposed to the hole 6, for receiving the bushing 2 as shown in FIG. 9. In this configuration, the bushing 2 provides an interference fit to the inside diameter of the accumulator housing 15 in addition to supporting the outlet tube 3 by replacing one of the tabs 1*a* of the previous embodiment. The bushing 2, as shown in FIG. 10, does not require the vertical grooves 2*b* or the chamfered edge 2*d* because it can be inserted in the open side of the passage 7 instead of inserted in the hole 6 of the previous embodiment.

Again, it is possible for the domed deflector 1 of the second embodiment to be utilized with the bushing 2 as shown in FIGS. 8 through 11, wherein the partially domed deflector has a flat 1*b*.

A third embodiment of the present invention provides for a fluid seal for improving the operation of the accumulator 14 while also providing a more robust assembly. A third embodiment of the present invention, shown in FIGS. 12 through 16, includes an extended skirt 2*e* preferably unitarily formed with the bushing 2 but possibly only integrally connected therewith. The extended skirt 2*e* fits within a lip. If of the deflector 1 around the entire circumference to provide a seal between the bushing 2 and the aluminum deflector 1. The skirt 2*e* of the bushing 2 prevents liquid refrigerant fluid, entering through the inlet 16 and passing over the deflector 1, from wrapping around the lip 1*f* of the deflector 1 and entering an inlet end 3*a* of the outlet tube 3.

The bushing 2 of the present embodiment also includes an extended tube portion 2*g* for receiving the outlet tube 3 for providing improved support of the bushing 2 on the outlet tube 3. The extended tube portion 2*g* preferably includes a slot 2*f* located next to the inner portion of the outlet tube 3 for exposing a portion of the outlet tube 3 containing an anti-siphon hole 3*b*. The present embodiment also preferably provides a unitary, one-piece bushing 2, including the extended skirt 2*e* and the extended tube portion 2*g*, for connecting the deflector 1 to the outlet tube 3. The present accumulator deflector assembly provides a cost effective, easier to assemble and better service life accumulator 14.

Although particular embodiments of the present invention have been illustrated in the accompanying drawings and described in the foregoing detailed description, it is to be understood that the present invention is not to be limited to just the embodiments disclosed. Numerous rearrangements, modifications and substitutions are possible, without departing from the scope of the claims hereafter.

What is claimed is:

1. An accumulator deflector assembly for an accumulator having a housing, said accumulator adapted to be used in an air-conditioning system, said accumulator deflector assembly comprising:

an annular bushing having a peripheral outer portion defining a circumferential groove and an inner passage having a converging end portion at one end of said inner passage;

a deflector body having an opening defining a passage therethrough, said deflector body being mounted to said bushing by said circumferential groove surrounding the edge of said opening; and a conduit mounted in said inner passage of said bushing whereby the outer periphery of said conduit communicates with said converging end portion of said inner passage so as to create a sealed interference between said conduit and said inner passage of said deflector body.

2. An accumulator deflector assembly as set forth in claim 1 wherein said passage of said deflector is a hole having a circular shape.

3. An accumulator deflector assembly as set forth in claim 1 wherein said passage of said deflector is a slot opening to an outer edge of said deflector and an outer diameter of said bushing extends beyond said outer edge of said deflector for creating an interference fit between said deflector and said housing of said accumulator.

4. An accumulator deflector assembly as set forth in claim 1 wherein said bushing is made of a thermoplastic material.

5. An accumulator deflector assembly as set forth in claim 1 wherein said deflector is made of aluminum.

6. An accumulator deflector assembly as set forth in claim 1 wherein said bushing further comprises a chamfered edge located on one side of said circumferential groove of said bushing, said chamfered edge having a plurality of vertical grooves evenly spaced around the circumference of said bushing for facilitating insertion of said bushing into said passage of said deflector.

7. An accumulator deflector assembly as set forth in claim 1 wherein said bushing further comprises an extended annular skirt having an outer diameter approximately equal to an inner diameter of said deflector, said extended skirt being a unitary part of said bushing.

8. An accumulator deflector assembly as set forth in claim 7 wherein said bushing further includes an extended tube portion having a slot for exposing a portion of said conduit having an anti-siphon hole located therein.

9. An accumulator deflector assembly as set forth in claim 7 wherein said bushing and said extended skirt are unitarily formed together.

* * * * *

UNITED STATES PATENT AND TRADEMARK OFFICE

CERTIFICATE OF CORRECTION

PATENT NO. : 5,904,055
DATED : May 18, 1999
INVENTOR(S) : Robert J. Slais

It is certified that error appears in the above-identified patent and that said Letters Patent is hereby corrected as shown below:

Column 1, line 40, kindly delete "Arnin et al." and insert ---- Amin et al. ----.

Column 1, line 50, kindly delete "Bretban et al. and insert ---- Breuhan et al. ----.

Column 2, line 4, kindly delete "die" and insert ---- the ----.

Column 3, line 28, kindly delete "tie" and insert ---- the ----.

Column 4, line 3, after "11-11" kindly insert ---- in ----.

Column 4, line 42, kindly delete "The" and insert ---- the ----.

Column 5, line 4, kindly delete "art" and insert ---- an ----.

Column 5, line 46, kindly delete "If" and insert ---- 1f ----.

Signed and Sealed this

Eleventh Day of July, 2000

*Attest:*

*Attesting Officer*

Q. TODD DICKINSON

*Director of Patents and Trademarks*